United States Patent [19]

Disco et al.

[11] 4,290,275

[45] Sep. 22, 1981

[54] HEAT PUMP WATER HEATER

[75] Inventors: Paulus J. Disco, Induno Olona; Ernesto Quargentan, Malnate; Pietro Santalucia, Laveno Mombello, all of Italy

[73] Assignee: U.S. Philips Corporation, New York, N.Y.

[21] Appl. No.: 75,478

[22] Filed: Sep. 14, 1979

[30] Foreign Application Priority Data

Sep. 13, 1978 [IT] Italy ..... 27609 A/78

[51] Int. Cl.[3] ..... F25B 27/02

[52] U.S. Cl. ..... 62/238.6; 62/238.7; 122/4 R

[58] Field of Search ..... 122/4 R; 62/238 E, 324 D

[56] References Cited

U.S. PATENT DOCUMENTS

| | | | |
|---|---|---|---|
| 2,516,094 | 7/1950 | Ruff | 62/238 E |
| 4,091,994 | 5/1978 | Madsen | 62/238 E |
| 4,148,355 | 4/1979 | Gehring | 62/238 E |

*Primary Examiner*—Edward G. Favors

*Attorney, Agent, or Firm*—Thomas A. Briody; William J. Streeter; Rolf E. Schneider

[57] ABSTRACT

There is provided a water storage heater having a heat pump including a compressor, a condenser and an evaporator. The condenser is arranged in heat relationship with a wall of an inner hot-water container. An outer shell is spaced from and surrounds the inner container to provide an interspace, at least part of the outer shell being constituted by the evaporator. Apertures are also provided in the outer shell to provide for air circulation through the interspace.

5 Claims, 4 Drawing Figures

HEAT PUMP WATER HEATER

This invention relates to a water storage heater comprising a heat pump and a water container heated by the heat pump.

It is well known to use a heat pump for a water heater in order to heat e.g. consumption water. Such a heat pump comprises a compressor, a condenser and an evaporator connected in a closed circuit, said circuit containing a refrigerant. In order to increase the efficiency of the heat pump, it has been proposed to arrange the condenser in the wall of the water container.

The object of the present invention is to provide a water storage heater with a heat pump in which high heat absorbing capacity of the evaporator is also obtained.

According to the invention there is provided a water storage heater comprising a heat pump including a compressor, a condenser and an evaporator connected in a closed circuit, an inner container for hot water having inlet and outlet means for said water, said condenser being arranged in heat relationship with a wall of the inner container, and an outer shell surrounding said inner container, wherein at least a part of the outer shell is provided with the evaporator.

Preferably the outer shell is formed from two superimposed plates defining a coil channel for the evaporator.

It is advantageous if the inner container is surrounded by thermal insulation, an interspace being left between the thermal insulation and the outer shell, said outer shell being provided with apertures. In this way heat absorption from the surrounding environment takes place at both sides of the evaporator.

Furthermore, it is advantageous, especially for containers of great capacity, if the interspace is divided by a vertical baffle into two parts which communicate with each other at their lower ends by way of a passage in which a fan is disposed. In this way a forced air circulation is obtained.

It is also advantageous if a conduit between the outlet of the condenser and the inlet of the evaporator is arranged at the location of the support base of the outer shell near the compressor.

The invention will now be described in detail in connection with the accompanying drawings, in which.

Figure 1:
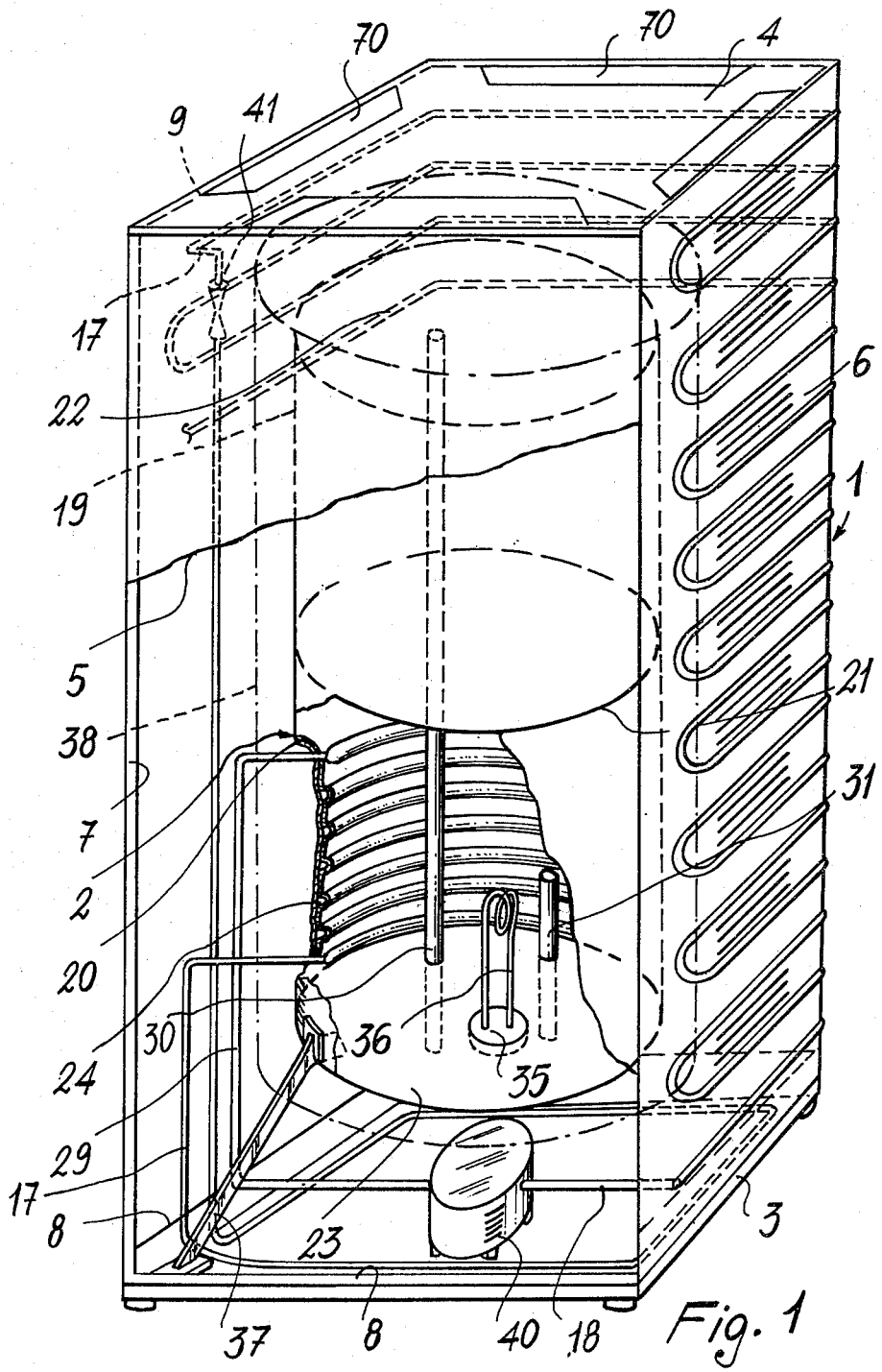
FIG. 1 is a diagrammatic perspective overall view of the water storage heater, with the front panel partly removed and the inner container partly cut away.

The water heater according to the invention comprises an outer shell, indicated by 1, in the shape of a right parallelepiped of substantially rectangular or square section, including an inner container indicated by 2.

The outer shell 1 comprises a base 3 pressed from a large thickness plate, a plate cover 4 bounded by apertures 70 or provided with ventilation slots, a removable front panel 5, and a plate 6 bent in the form of a U, defining three sides of the shell 1 and representing the evaporator of a heat pump. The front panel 5 is fixed by screws to the flanges 7 along the front edges of the plate 6 and to the flange 8 of the base 3. The plate 6 is fixed along its lower contour to the remaining three flanges 8 of the base 3, by screws or welding. The cover 4 is removably connected by screws to flanges 9 on the three upper sides of the plate 6. The plate 6 shown here, which as stated constitutes the evaporator of the heat pump, is constructed by brazing together two plates 10, 11, one of which has previously been provided with a coil indentation 12 by drawing. After brazing, the coil indentation 12 defines with the other plate a channel 13 which is traversed by the refrigerant fluid, constituting the thermal energy carrier in the heat pump, in the form of a halogenated saturated hydrocarbon, e.g. dichlorodifluoromethane.

Another method of constructing the plate 6 is known by the name of Roll Bond. This method consists of marking the path of the channel on an aluminium plate by a silk-screen process using suitable substances, then placing another aluminium plate on the former, then heating these plates to the plastic state, then pressing the plates one against the other and separating the plates at the channel marking by a pressurised gas fed to the ends of the marked portion.

Figure 3:
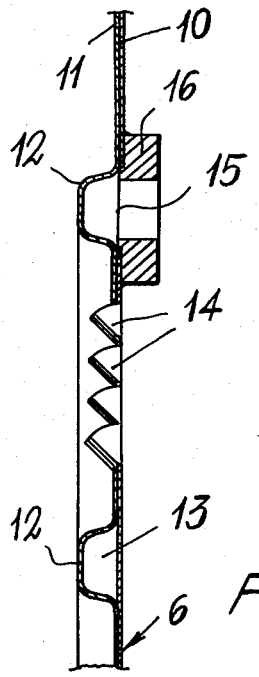
FIG. 3 is a partial vertical section through the evaporator which partly forms the outer shell of the water heater.

In the case in question, after joining together the plates 10, 11, finned apertures 14 are constructed in the plate 6 by pressing and bending (see FIG. 3).

Bores 15 are provided in the plate 10 at the end of the channel 13, and around each of these there is welded a connection ring 16 for connecting the conduits 17, 18 by means of which the channel 13 is connected to the heat pump circuit.

The plate 6 is then bent in the shape of a U to form the three walls of the outer shell 1, after bending the flanges 7 and 9 which serve for respectively fixing the front panel 5 and the cover 4.

The substantially cylindrical inner container 2 is formed from two cylindrical sections 19 and 20 welded together along the line 21 of FIG. 1. The container 2 also comprises two ends, an upper end 22 and a lower end 23, welded respectively to the free ends of the sections 19 and 20. The ends 22, 23 and the section 19 are formed from a single plate, whereas the section 20, which constitutes the heat pump condenser, is constructed from a cylindrically bent plate welded at its ends and formed, using one of the previously mentioned methods, by superimposing two plates 25, 26, at least one of which comprises a coil indentation obtained by drawing. On superimposing the plates, a channel 24 is obtained for the passage of the refrigerant fluid. At the ends of said channel, bores 27 are provided in one of the plates 25, 26, and around each of them is welded a connection ring 28 for connecting the channel 24 to the pipes 29 and 17 of the heat pump circuit.

The end 23 is traversed in a sealed manner by two conduits 30 and 31 of different lengths. The shorter conduit 31 is connected in any known manner to a source of cold water, and the longer conduit 30 is connected to the utilisation points for the hot water.

In the centre of the lower end 23, there is provided a bore in which is removably seal-mounted a plug 35 supporting an electric heater element 36 which is operated to heat the water when the temperature of the environment in which the water heater is disposed is insufficient, i.e. too low to enable the heat pump to operate effectively.

The container 2 is supported by the base 3 by way of four support feet 37 in such a manner that it is spaced apart from the base. FIG. 1 shows only one of these feet for simplicity.

The container 2 is given a covering of insulating material 38, the profile of which is shown by dash-dot lines in FIG. 1. This insulating covering may consist of pre-shaped expanded polyurethane pieces glued together and to the container 2. The covering can also be prepared by placing the container 2 in a mould and introducing a mixture of the components into the interspace between the mould and the container, then foaming them in situ to form a mass of expanded polyurethane in known manner. Alternatively, the thermal insulation 38 may be prepared by fixing layers of glass or mineral wool to the inner container by adhesives.

Between the insulation and the shell there is an interspace to enable atmospheric air to make contact with the evaporator 6 both on its inner side and on its outer side, so that the entire evaporator surface takes part in the heat transfer.

The support feet 37 keep the container 2 at a level from the base 3 sufficient to enable the motor driven compressor 40 of the heat pump to be disposed in the resultant interspace, and fixed to the base. The delivery side of the motor driven compressor 40 is connected to the condensing section 20 by way of the conduit 29, and the suction side is connected to the evaporating plate 6 by way of the conduit 18. A throttle valve 41 is connected in the conduit 17 which joins the condensing section 20 to the plate 6. The conduit 17 is in the form of a coil turn in heat transfer contact with the base 3 to improve evaporation of the condensate.

From the above, it can be seen that the heat pump is formed from the components 40, 29, 20, 17, 41, 6 and 18.

Its operation is as follows:

When the water in the container or tank 2 is to be heated, a normal thermostat, not shown, starts the motor driven compressor 40. The refrigerant fluid arrives hot in the condensing section 20, passes through the coil turn formed by the conduit 17, then through the throttle valve 41 to expand into the evaporating plate 6 where it absorbs heat from the external environment. It then arrives at the compressor 40 which recirculates it.

Figure 2:
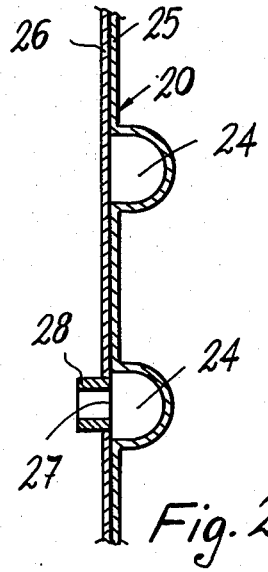
FIG. 2 is a partial vertical section through the inner container at the condenser part.
Figure 4:
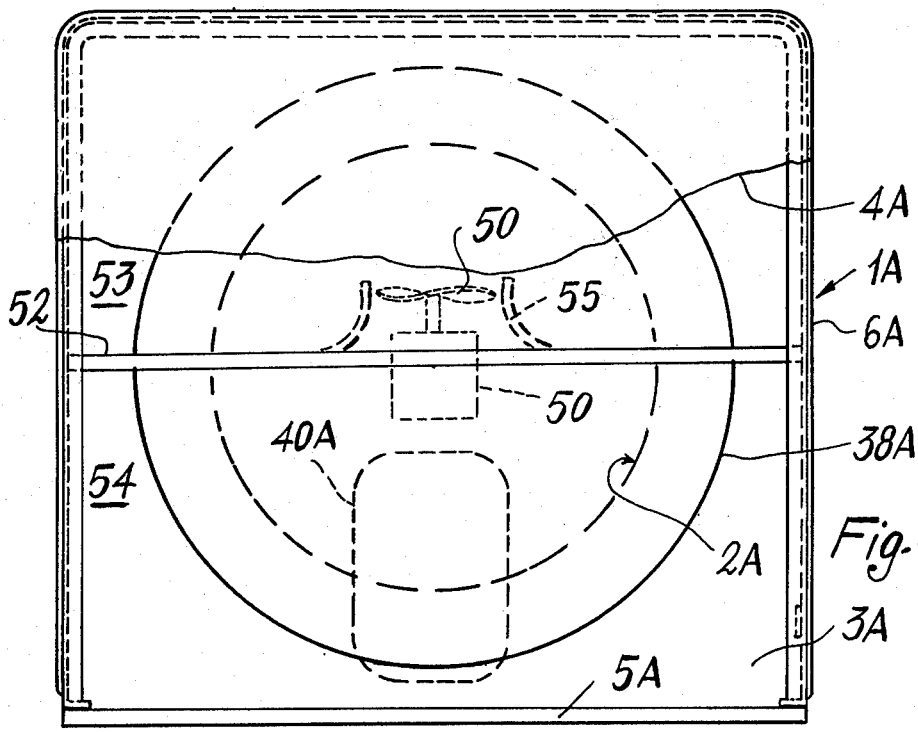
FIG. 4 is a plan view of a modification of the water heater, with the cover partly cut away.

FIG. 4 shows a plan view of a modification in which the atmospheric air in contact with the evaporating plate is moved by a fan 50. In this embodiment, parts equal or similar to those of the embodiment of FIGS. 1 to 3 have been given the same reference numerals, followed by the letter A. In this case, the cover 4A is completely closed, i.e. without the apertures 70 provided in the cover 4. A vertical separation baffle 52 divides the space between the thermal insulation 38A and the outer shell 1A into two chambers 53, 54 which communicate with each other at their lower ends via a passage 55 in which the axial electric fan 50 is mounted, supported by the base 3A. When the fan is in operation, the chamber 53 is under suction, while the chamber 54 is under pressure. The air drawn through the finned apertures 14 of the evaporating plate 6 which face said chamber then moves along this chamber in a descending direction not only by the effect of the cooling which it undergoes, but also by being drawn by the fan. The air drawn by the fan strikes the motor driven compressor 40A (disposed suitably in front of the fan) so that it cools the compressor and itself becomes heated.

The air, thrust by the fan, rises through the chamber 54 and is discharged through the finned apertures 14 (located there). This forced circulation allows greater heat absorption by the plate 6A than by the identical evaporating plate 6 of the embodiment shown in FIGS. 1 to 3, all other conditions being equal.

What is claimed is:

1. A water storage heater comprising a heat pump including a compressor, a condenser and an evaporator connected in a closed circuit; a vertically disposed inner hot-water container having a cold water inlet and a hot water outlet, said condenser being arranged in heat relationship with a wall of said inner container; and an outer shell spaced from and surrounding said inner container to provide an interspace, at least a part of said outer shell being constituted by said evaporator, said outer shell being provided with apertures.

2. A water heater according to claim 1, which includes a vertical baffle dividing the interspace into two parts communicating with each other at their lower ends by way of a passage, and a fan disposed in said passage.

3. A water heater according to claim 1 or 2, in which the outer shell is formed from two superimposed plates defining a coil channel comprising the evaporator.

4. A water heater according to claim 1 or 2, which includes a support base for the outer shell adjacent the compressor, and a conduit between the outlet of the condenser and the inlet of the evaporator arranged on said support base.

5. A water heater according to claim 1 or 2, in which the inner container is surrounded by thermal insulation.

* * * * *